US006227451B1

(12) United States Patent
Caruso

(10) Patent No.: US 6,227,451 B1
(45) Date of Patent: May 8, 2001

(54) RADIANT HEATER SYSTEM

(76) Inventor: Pat Caruso, c/o SRP, 428 Millen Road, Unit 23, Stoney Creek, Ontario (CA), L8E 3N9

( * ) Notice: Subject to any disclaimer, the term of this patent is extended or adjusted under 35 U.S.C. 154(b) by 0 days.

(21) Appl. No.: 09/588,324

(22) Filed: Jun. 6, 2000

Related U.S. Application Data

(60) Provisional application No. 60/139,432, filed on Jun. 8, 1999.

(51) Int. Cl.[7] ..... G05D 23/00

(52) U.S. Cl. ..... 237/2 A; 237/70; 165/146

(58) Field of Search ..... 237/2 A, 1 R; 126/92 AC, 391; 165/146, 147

(56) References Cited

U.S. PATENT DOCUMENTS 3,758,031 * 9/1973 Moran ..... 237/12.3 C
4,529,123 * 7/1985 Johnson ..... 237/1 R
4,727,854 * 3/1988 Johnson ..... 126/92 B
4,813,396 * 3/1989 Sargeant et al. ..... 126/391
4,869,230 * 9/1989 Fletcher ..... 126/91 A
5,265,673 * 11/1993 Hucsko ..... 165/176

* cited by examiner

*Primary Examiner*—Harold Joyce
*Assistant Examiner*—Derek S. Boles

(57) ABSTRACT

A radiant heater system of the type having an radiant energy emitter conduit, the radiant heater system comprising an emitter extending at least partly through the area to be heated. The radiant heater system further including a burner for burning fuel thereby forming combustion products, said burner connected to an inlet end of the emitter to inject thermal energy into the emitter and an exhaust end of the emitter serving to exhaust combustion products. The radiant heating system further including an air intake sleeve for controlling the amount of combustion air available to said burner, and a blower sized to provide dilution air communicating with said burner wherein the dilution air cools the combustion products proximate said inlet end thereby reduces the emitter temperature proximate said inlet end.

19 Claims, 5 Drawing Sheets

FIGURE - 2
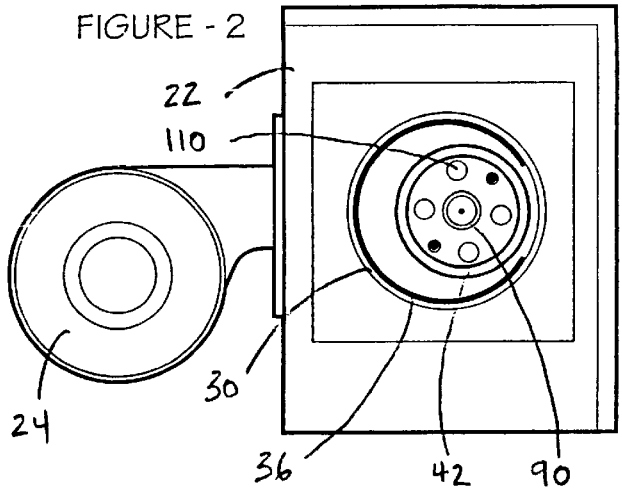
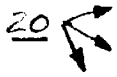
FIGURE - 1
FIGURE - 3
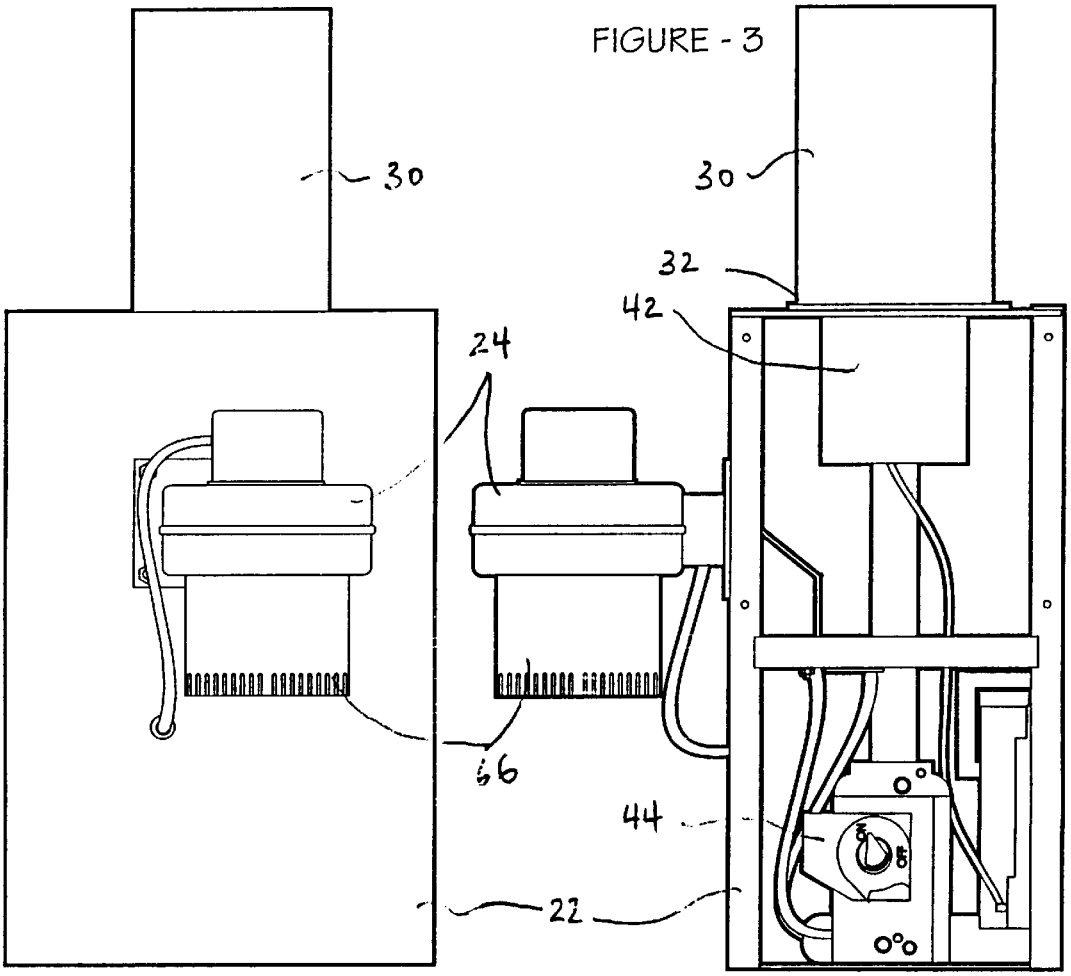

Top 220
Bottom 222
20
24
31
32
34
42
44
60
92
22
30
120
122
124
26
27
36
38
50
52
64
68
74
104
Floor Temperature
DISTANCE ALONG EMITTER

RADIANT HEATER SYSTEM

This application claims benefit to U.S. provisional application No. 60/139,432, filed Jun. 8, 1999.

FIELD OF THE INVENTION

This invention relates generally to indoor heating systems and specifically to a radiant heater system.

BACKGROUND OF THE INVENTION

Tube fired radiant energy heater systems are frequently used in industrial and commercial buildings which are difficult to heat. In such applications, radiant energy heating systems are regarded as superior to forced air systems from the stand points of the economy and comfort in minimizing the stratification of heat from top to bottom in a building and in fuel savings. Tube fired radiant heaters radiate heat downwards towards the floor thereby heating the floor and taking advantage of the natural convection of heat from the bottom to the top of the interior of the building.

Tube fired radiant heating systems normally include a burner mounted at the inlet end of an emitter tube which radiates heat along its length to the exhaust and of the emitter tube wherein the combustion products are naturally vented away into the atmosphere. The temperature of the emitter tube naturally varies from the inlet end to the exhaust end, the hottest end being nearest the combustion flame of the burner at the inlet end and the coolest area of the emitter tube normally being the exhaust end where the exhaust gases are vented to the atmosphere. This results in an undesirable temperature profile (or temperature drop) along the emitter tube, the inlet being the hottest end of the emitter tube and the exhaust end being the coldest part of the emitter tube. Most indoor heating systems strive to produce as uniform as possible, temperature distribution throughout the building that is being heated. Unfortunately the temperature profile that is present in most radiant tube emitters creates non uniform heating along the length of the emitter tube and therefore, non uniform temperatures throughout the building that is being heated.

The problem is further exacerbated the longer the emitter tube being supplied with heat from a single burner. Therefore, building configurations which are long and narrow requiring long emitter tubes are particularly susceptible to a larger temperature profile from the inlet end to the exhaust end in a radiant tube heater system.

Some attempts have been made to minimize this problem and in particular U.S. Pat. No. 4,529,123 filed by Arthur C. W. Johnson on Sep. 2, 1983 and issued on Jul. 16, 1985 and assigned to the Combustion Research Corporation describes an attempt to minimize the temperature profile along a radiant heater emitter tube. U.S. Pat. No. 4,529,123 utilizes an insulated sleeve along the inlet portion of the emitter tube in order to reduce the amount of heat transferred to the emitter tube along the first portion of the emitter tube. The Patent discusses insulating materials such as magnesium oxide, aluminum oxide, ceramic materials, solid materials, glomerate fired and/or laminated sheets. Preferably the use of a ceramic insulator material is recommended which is manufactured by Carborundum Corporation under the Trademark Fiberfrax™. The patent disclosures that a more uniform temperature distribution along the emitter tube is achieved by using insulated sleeves however, a number of drawbacks have been experienced using this type of insulation method. In commercial practice the insulating material within the emitter tube tends to erode preferentially in certain areas due to direct impingement of the burner flame onto the insulating material and/or local hot spots caused by either small imperfections within the insulating material and/or in and around areas where connections in the insulating material have been made. Where a local hot spot develops in the insulating material, the emitter tube quickly heats to temperatures far beyond normal which it is capable of handling and often emitter tube failure will occur quickly thereafter.

In U.S. Pat. 4,044,751 by Arthur C. W. Johnson, filed May 19, 1975 and issued May 30, 1977 and assigned to the Combustion Research Corporation, the inventor describes a radiant energy heating system with power exhaust and excess air inlet. The object of the invention was to reduce the inlet and emitter tube temperature in order to reduce oxidation of the emitter tube and also to ensure that structural integrity was maintained of the emitter tube and also to be able to use lighter strength and thinner gauge emitter tubes in order to reduce the cost of radiant tube heaters. The patent does not discuss the possibility of using this technique for producing a more uniform temperature profile along the length of the emitter tube, but rather is essentially concerned with reducing the emitter end temperature in order to avoid material breakdowns.

It is desirable to have a radiant heater system having a more uniform emitter tube, temperature profile along its length in order to provide for more uniform heating particularly in spaces requiring very long emitter tubes. The more uniform the temperature profile along the emitter tube the more uniform heating can be achieved. In some instances, uniformity of temperature is highly critical, as for example in animal confinement and/or other applications.

SUMMARY OF THE INVENTION

The present invention a radiant heater system of the type having an radiant energy emitting emitter conduit, the radiant heater system comprises a) an emitter extending at least partly through the area to be heated;

b) a burner means for burning fuel thereby forming combustion products, said burner connected to an inlet end of the emitter to inject thermal energy into the emitter;

c) an exhaust end of the emitter serving to exhaust combustion products from the burner; and, d) a means for supplying dilution air to combustion products released by said burner means, wherein the dilution means cools the combustion products proximate said inlet end thereby reducing the emitter temperature proximate said inlet end.

Preferably the radiant heater system further comprises a means for lining the interior of said emitter, such that the liner means reduces the heat transferred to the emitter adjacent said liner.

Preferably the radiant heater system comprises an emissivity means for varying the emissivity of said emitter along the length of the emitter such that the emissivity means is employed to control the amount of radiant heat emitted by the emitter as a function of the distance along the emitter.

Preferably the radiant heater system wherein said dilution means includes an air intake sleeve for controlling the amount of combustion air available to said burner.

Preferably said air intake sleeve also providing for a dilution air passageway directing dilution air for mixing with said combustion products.

Preferably said lining means includes a liner adapted to lie adjacent a portion of the inner periphery of said emitter.

Preferably said lining means includes a sheet metal liner formed to lie adjacent a portion of the inner periphery of said emitter.

Preferably said emitter being tubular and said lining means including an emitter liner gap along the bottom of the emitter inner periphery for minimizing heat distortion of the emitter and promoting a more uniform vertical temperature distribution within said emitter.

Preferably said emissivity means includes said emitter being constructed of numerous emitter lengths wherein each emitter length having a preselected emissivity, wherein emitter length emissivities are preselected in order to maximize the temperature uniformity of the emitter along the emitter length.

Preferably the radiant heater system comprises a baffle inserted into the interior of said emitter proximate the exhaust end for promoting increases heat transfer to said emitter proximate said exhaust end and thereby providing a more uniform emitter temperature profile along the length of the emitter.

BRIEF DESCRIPTION OF THE DRAWINGS

The invention will now be described by way of example only, with references to the following drawings in which:

FIG. 1 is a schematic top plan view of the burner housing showing the top mounted blower and a portion of the emitter;

FIG. 2 is a side elevational view of the burner housing showing the blower mounted on top and viewing into the end of the emitter, showing a portion of the burner cup;

FIG. 3 is a side elevational view with the side panel removed exposing the contents of the burner housing including the gas regulator, the top mounted blower, a portion of the emitter as well as a portion of the air intake sleeve;

DETAILED DESCRIPTION OF THE PREFERRED EMBODIMENT

Figures 4, 5, 6:
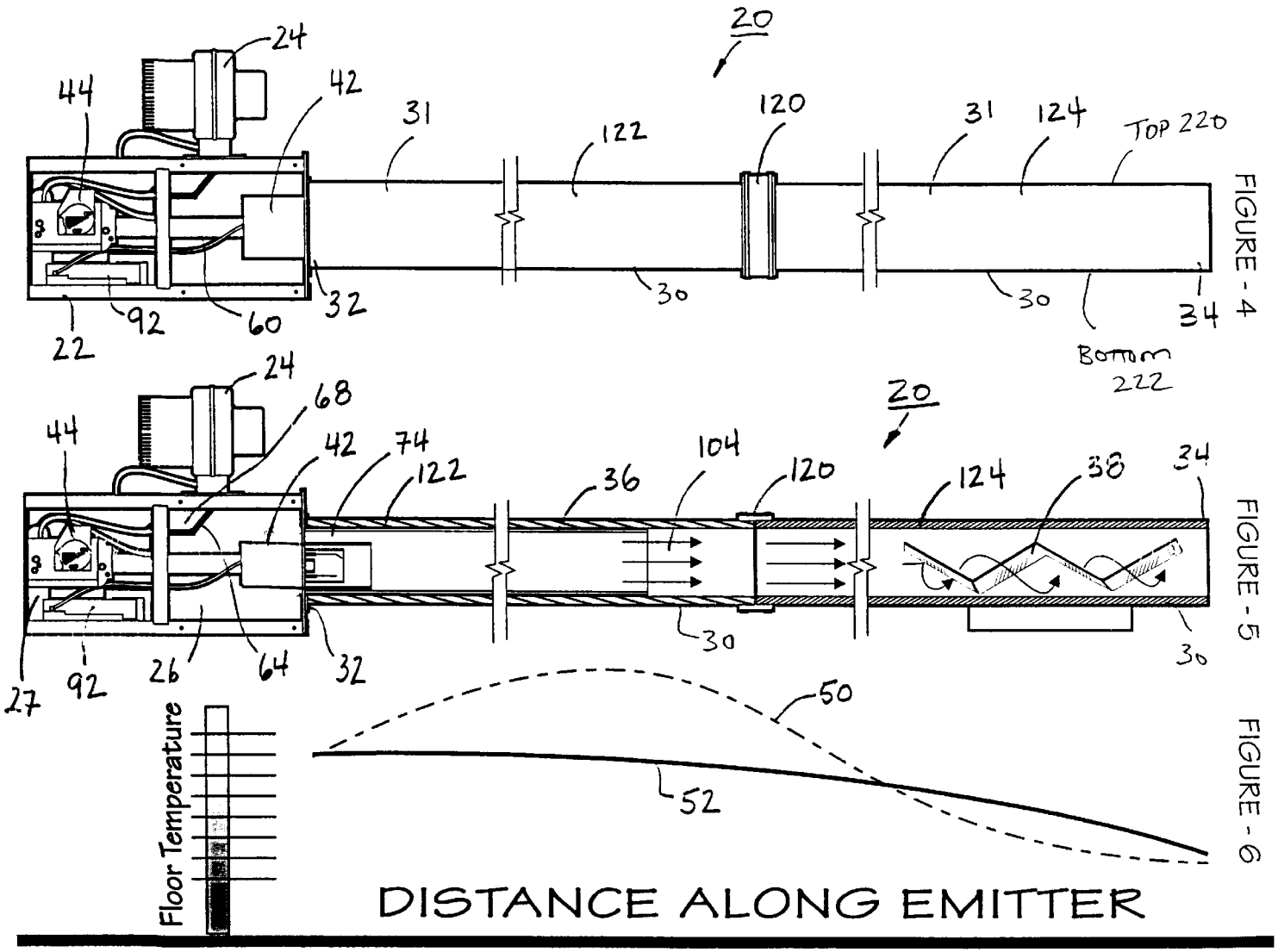
FIG. 4 is a schematic side elevational view of the radiant heater system with the side panel removed from the burner housing, showing the burner unit together with the emitters and a coupling.
FIG. 5 is a schematic side cross-sectional view of the radiant heater system shown in FIG. 4, showing in cross-section the emitter detail along its length.
FIG. 6 is a schematic graphical representation of the floor temperature as a function of the distance along the emitter reflecting the temperature profile along the emitter.
Figure 8:
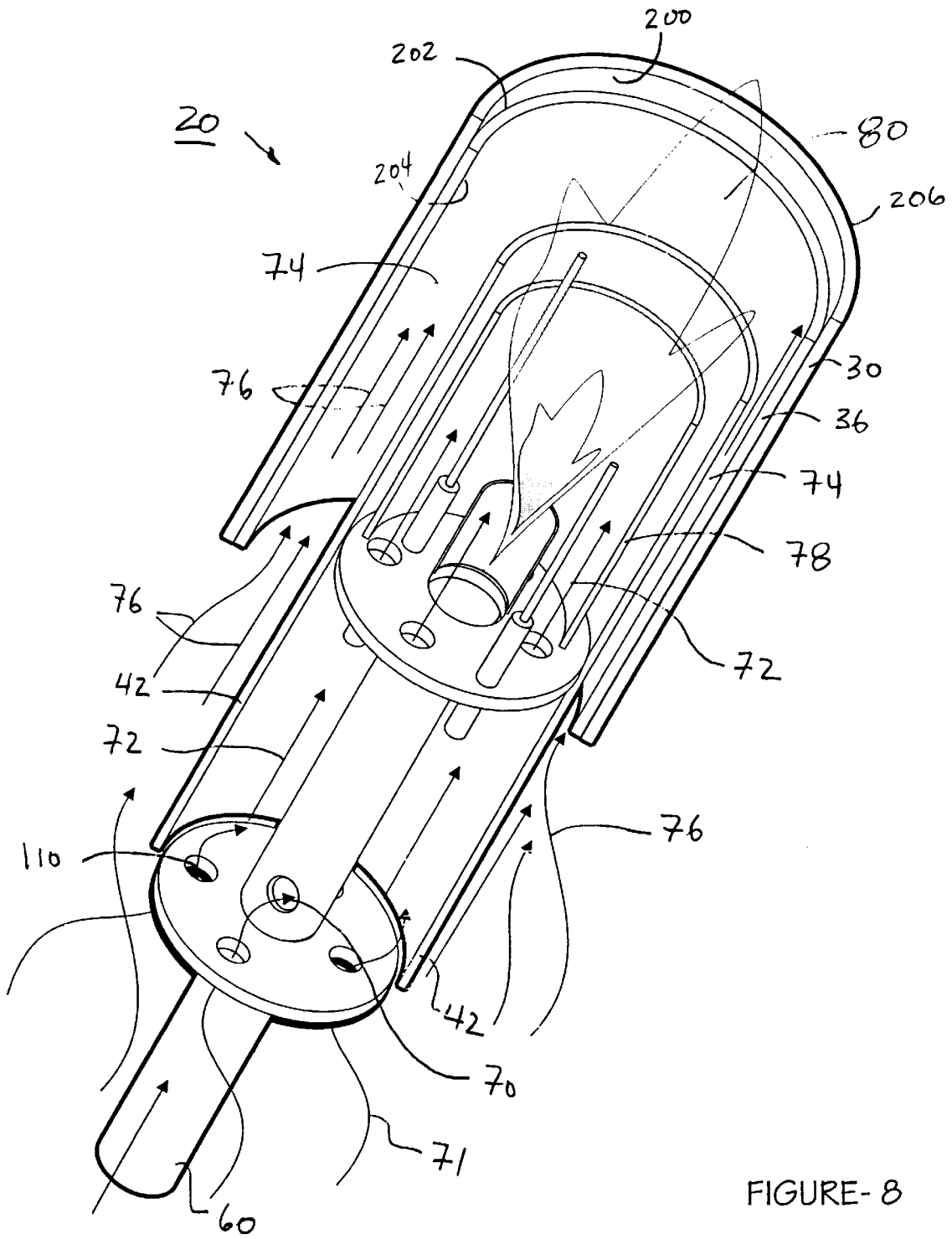
FIG. 8 is a schematic perspective partial cut away view of the burner assembly showing details of the air intake sleeve, the burner, the dilution air passageway as well as the emitter tube and the emitter liner.

The present invention, radiant heater system, shown generally as 20 is shown in schematic fashion in FIGS. 5 and 8. The major components of radiant heater system 20 include burner housing 22, blower, 24, air inlet compartment 26, air intake sleeve 42, control compartment 27 having gas regulator 44, burner 90, emitter 30 having inlet end 32 and exhaust end 34 and optionally emitter liner 36 and exhaust baffle 38 and coupling 120. In addition emitter 30 has an emitter inner periphery 200, emitter outer periphery 206, liner outer periphery 202, and liner inner periphery 204. The emitter has a length extending from the inlet end 32 to the exhaust end 34.

Referring now to FIG. 6, which is a schematic representation of the floor temperature shown as a function of the distance along the emitter tube, the prior art or the normal temperature distribution is shown in the dashed line, whereas the present invention which is shown in the solid line provides for a more uniform temperature distribution along the distance of the emitter.

The invention will now be described in more detail as to how it provides for a more uniform temperature profile along the length of the emitter. Still referring to FIG. 6, the dashed line 50 shows the prior art exhibiting a fairly steep temperature increase adjacent burner 90 followed by a substantial decrease in temperature moving away from inlet end 32 towards exhaust end 34 of emitter 30. In contrast the solid line 52 which schematically represents the current invention, provides for a relatively flatter temperature profile along the distance of the emitter. Therefore the total temperature fluctuation exhibited by prior art devices dashed line 50 is much greater than the total temperature fluctuation provided for by the current invention solid line 52.

Dilution Air

Figure 10:
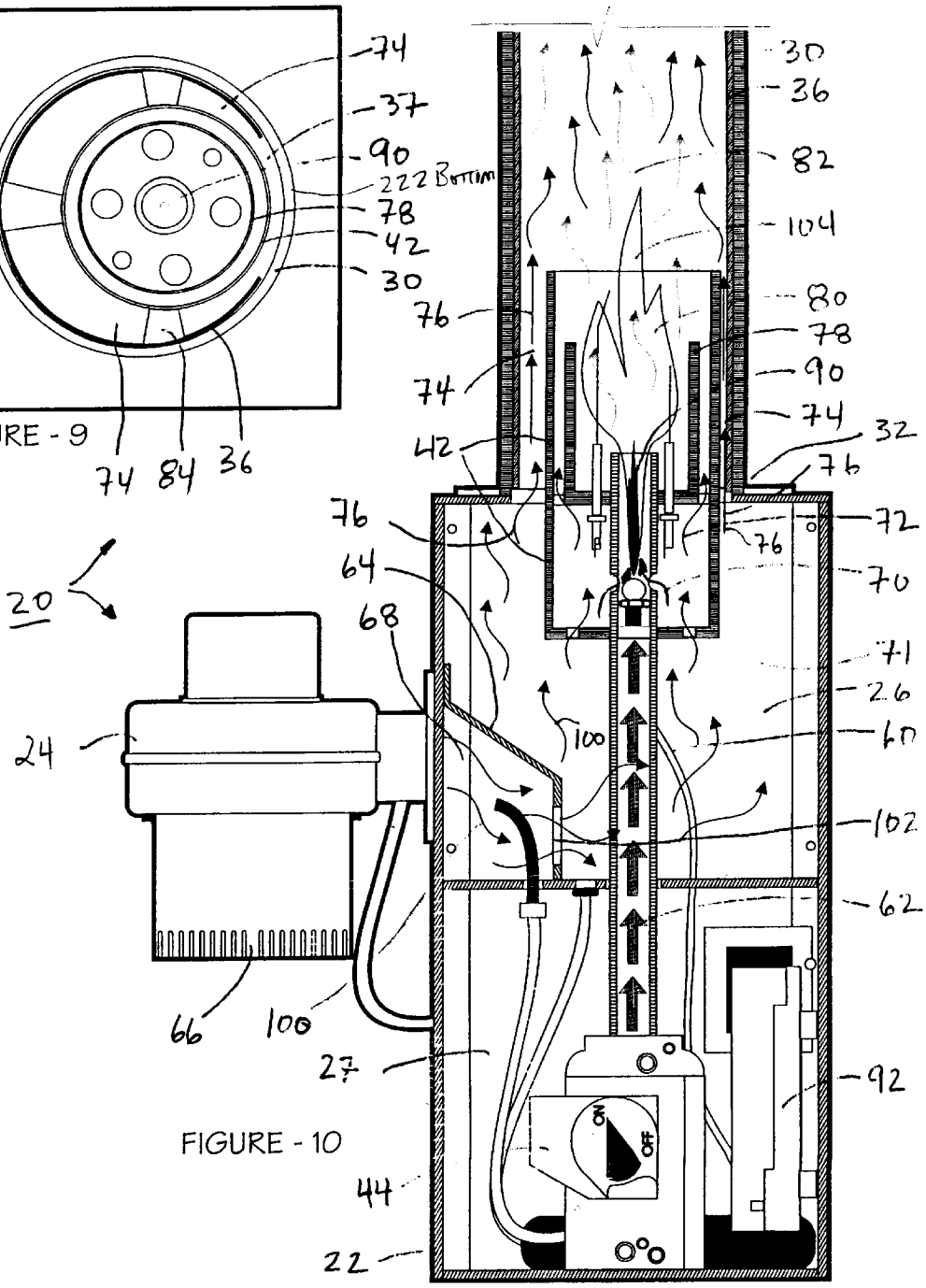
FIG. 10 is a schematic side partial cross-sectional view of the burner together with a portion of the emitter showing the details of the air flow through the burner as well as the emitter and details of the dilution air and the dilution air passageways.

Referring now to FIG. 10 which is a schematic partial cross-sectional view of radiant heater system 20 including burner housing 22 as well as a portion of emitter 30.

Burner housing 22 includes a control compartment 27 having disposed therein an electrical control 92, a gas regulator 44, a fuel supply line 60 communicating fuel 62 to burner 90.

Burner housing 22 further includes air inlet compartment 26 having mounted thereon a blower 24 having an air intake 66 for receiving ambient air into blower 24 and communicating air 100 into air control compartment 68. Air control compartment 68 includes an air baffle 64 having an opening 102 for communicating air 100 from air control compartment 68 into air inlet compartment 26. Air 100 within air inlet compartment 26 is divided into two main streams; the air passing through air intake sleeve 42 providing combustion air 71 for a burner 90 and secondly, dilution air 76 passing through dilution air passageway 74.

Fuel 62 passing through fuel supply line 60 is ejected at burner 90 and is mixed with primary combustion air 70 producing a combustion flame 80 and combustion products 104 which travel along emitter 30.

Dilution air 76 passing through dilution air passageway 74 intermixes with combustion products 104 from combustion flame 80 thereby reducing the temperature of combustion products 104 and the ambient temperature within emitter 30 nearest inlet end 32.

Air intake sleeve 42 acts as an air choke controlling the amount of combustion air 71 entering through and into air intake sleeve 42 and thereby controlling the amount of combustion air 71 available for burning of fuel 62. Burner cup 78 houses ignition devices for lighting combustion flame 80 as well for providing a stabilized combustion area for combustion flame 80. Secondary combustion air 72 passes between burner cup 78 and air intake sleeve 42 thereby providing further combustion air for ensuring that complete combustion of fuel 62 takes place in combustion flame 80.

Primary combustion air 70 and secondary combustion air 72 ensure that a stoichiometric amount of air is provided and mixed with fuel 62 to ensure for substantially complete combustion of fuel 62. In practice, a slightly excessive (usually 10 to 50% above stoichiometric) amount of secondary combustion air 72 and primary combustion air 70 is supplied to fuel 62 to ensure complete and thorough burning of fuel 62. In other words, total combustion air supplied in normal practice ranges from 1.1 to 1.5 times stoichiometrically required air for complete combustion.

Dilution air 76 passing through dilution passageway 74 is cool unmixed air which mixes with combustion products 104 when these combustion products leave air intake sleeve 42 and burner cup 78. The mixing of combustion products 104 with dilution air 76 results in the lowering of the combustion products temperature and ultimately the temperature of emitter 30 relative to the temperature that would be observable had no dilution air been introduced.

In practice, dilution air 76 can be one to 10 times the amount of stoichiometric air required for combustion of fuel 62 preferably, however, the dilution air 76 is proximately two to five times the stoichiometric air required for combustion of fuel 62.

It will be apparent to a person skilled in the art that blower 24 must be sized accordingly to provide the excess dilution air 76 required over and above the combustion of air 71 required for the combustion of fuel 62.

Figure 9:
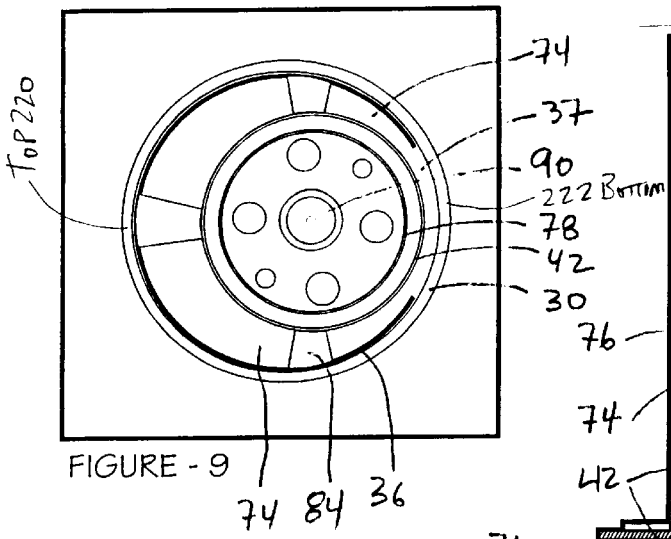
FIG. 9 is a front elevational view showing the emitter, the emitter liner, the burner, the burner cup as well as the dilution air passageway.

Referring now to FIG. 9 which is a cross-sectional view taken through emitter 30 and looking into burner 90, it includes air intake sleeve 42, emitter liner 36, emitter 30, burner 90, burner cup 78, dilution air passageway 76, and support flanges 84. One can see that air intake sleeve 42 which is roughly concentric with burner cup 78 and burner 90, is not mounted concentrically within emitter tube 30. Burner cup 78 along with air intake sleeve 42 is mounted off centre purposely and proximate the bottom portion of emitter 30 in order to offset the natural tenancy for hot air to rise and heat the top portion of emitter 30 in preference to the bottom portion of emitter 30. Support flanges 84 position air intake sleeve 42 within emitter 30 providing the desired position.

Figure 7:
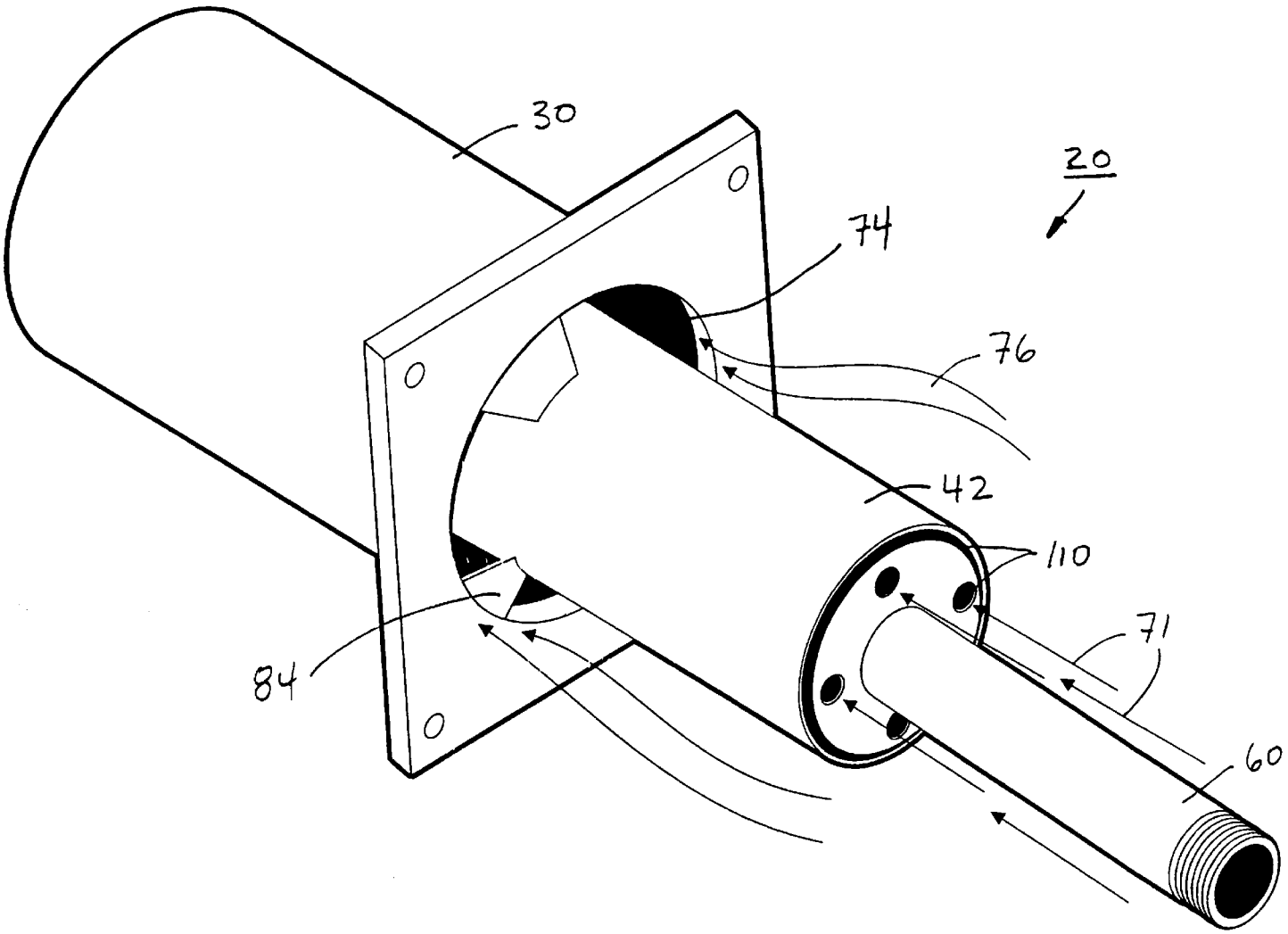
FIG. 7 is a perspective view showing a portion of the burner including the fuel supply line, a portion of the air intake sleeve, as well as a portion of the emitter tube.

Referring now to FIG. 7, which shows the separation of air 100 into two main streams, the first one being combustion air 71 which flows into air intake sleeve 42 through air inlets 110 for the purpose of mixing with fuel 62 and providing for combustion flame 80. As already stated before, combustion air 71 is further divided into secondary combustion air 72 and primary combustion air 70 which together in practice normally provide for a slightly greater amount of air than stoichiometrically required to bum fuel 62. The amount of excess air required to bum fuel 62 is known in the art and depends upon the burner design and the type of fuel used and generally speaking ranges anywhere from 10% to 50% excess air above the stoichiometric amount required to just burn fuel 62.

Still Referring to FIG. 7, the second stream of air 100 is dilution air 76 which flows through dilution air passageway 74 which passageway is defined as the area between intake sleeve 42 and the inner wall of emitter 30.

FIG. 8 in similar fashion shows in cross-sectional view the details of air intake sleeve 42, fuel supply line 60, fuel 62, combustion flame 80, combustion air 71, primary combustion air 70, secondary combustion air 72, dilution air 76, dilution air passageway 74, and emitter 30.

Emitter Liner

Referring now to FIG. 5 which shows in schematic fashion the lengths of emitter 30 which are joined together by coupling 120. FIGS. 4 and 5, show two emitter lengths 31 however, in practice there may be 2. 3, 4, 5 and more emitter sections joined together by couplings 120 to create a total emitter length of anywhere between 10 and 100 feet. In order to reduce the temperature of emitter 30 near inlet end 32, emitter 30 is fitted with an emitter liner 36 which preferably extends from the inlet end 32 to approximately 20 to 50% of the entire emitter length 30.

Emitter liner 36 preferably is made of metallic materials such as aluminum and/or steel and preferably is made of stainless steel and preferably utilizes ASTM 304 stainless steel sheet Material. As shown in FIG. 9, emitter liner 36 extends partway around the inner periphery of emitter tube 30, thereby leaving an emitter liner gap 37 along the bottom portion of emitter 30. The purpose of emitter liner gap 37 is to create a more uniform temperature distribution between the upper and lower portions of emitter 30. Emitter liner gap 37 tends to offset the natural temperature gradient which is observed in the interior of emitter 30 between the top portion and the bottom portion of the emitter tube. Naturally rising hot gases tend to create a hotter surface on the top side of emitter 30 than on the bottom side of emitter 30. Therefore, the emitter liner gap 37 allows greater heat transfer along the bottom of emitter 30 whereas, where the emitter liner 36 is positioned, less heat is transferred to emitter 30. Emitter 30 may warp and/or bow should the natural temperature gradient between the top of emitter 30 and the bottom of emitter 30 become to great. Therefore, in order to avoid heat distortion of emitter 30, emitter liner gap 37 provides for a more uniform temperature distribution between the upper and lower surfaces herein referred to as (the vertical temperature distribution) of emitter 30 and thereby helps to minimize heat distortion of emitter 30.

Preferably the inside of emitter liner 36 is a smooth and/or mirror finish in order to reflect heat back in towards the centre of emitter 30 thereby minimizing the amount of heat transferred to emitter 30. In addition in order to maximize the contact resistance between the outer surface of emitter liner 36 and the inner surface of emitter 30, preferably emitter liner 36, has an outer smooth surface and emitter 30 has a rougher inner surface, thereby maximizing the contact resistance.

Preferably emitter liner 36 is a stainless sheet steal which is formed into a tubular section having a diameter slightly larger than the inner diameter of emitter 30. Therefore, when emitter liner 36 is placed within emitter 30 it is held in place by friction as well as by spring contact of the emitter liner 36 naturally wanting to expand to a large diameter than the inner diameter of emitter 30.

Variable Emissivity Emitters

Referring to FIGS. 4 and 5, which shows schematically emitter 30 comprised of a number of emitter lengths 31 joined together with couplings 120. Preferably, to flatten out the temperature profile shown in FIG. 6 as much as possible, (ie. reduce the temperature gradient) materials are selected for the emitter having a low emissivity proximate the inlet end and moving along the emitter toward the exhaust end, higher and higher, emissivity materials would be selected in order to increase the heat transfer of the emitter as one approaches the exhaust end 34. Therefore, the heat released from burner 90 would be more uniformly released along the length of emitter 30 thereby radiating more evenly the heat along the length of emitter 30.

By way of example only and not to limit the concept of using variable emissivity emitters, looking to FIG. 5 which shows two emitter lengths 31 of emitter 30, one could for example use a low emissivity emitter 122 for the emitter length 31 closest to inlet end 32. Low emissivity emitter 122 may have an emissivity of approximately 0.2 to 0.5 which is obtainable from a mild steel which is either aluminized or zinc aluminum coated. For the second emitter length 31 one would use a high emissivity emitter section 124 having an emissivity of approximately 0.7 to 0.8 which is obtainable using a mild steel which is either oxidized from the hot rolling process (commonly termed hot rolled steel) and/or aluminized and heat treated in order to produce a higher emissivity emitter section 124.

As a result the low emissivity emitter 122 would radiate less heat proximate the inlet end 34 and high emissivity emitter 124 would radiate more heat near the exhaust end 34.

Persons skilled in the art would recognize that various combinations of emissivities could be used and a gradual gradient from a low emissivity emitter from inlet end 32 to a higher emissivity emitter near the exhaust end 34 could be employed depending upon the number of sections of emitter 30 along the entire emitter 36 length, and/or the result one wishes to achieve.

Exhaust Baffle

In addition to using the dilution air 76, the emitter liner 36, the low emissivity emitter 122 and the high emissivity emitter 124 (ie. the variable emissivity emitters) one can additional improve the heat transfer to the emitter 30 near the exhaust end 34 by using a exhaust baffles 38 as shown schematically in FIG. 5. Exhaust baffles 38, well known in the art can aid the heat transfer of heat from the exhaust gases to the emitter 30 in the section of the emitter they are deployed thereby increasing the radiation emitted from the emitter 30 and exhaust end of emitter 30. A person skilled in the art of radiant tube heating recognizes that most baffles commercially available currently could be used in order to obtain the necessary function of exhaust baffle 38.

In Use

In order to provide for a more uniform temperature profile along the length of the emitter, first of all the radiant heater system 20 would be fitted with the capability of introducing dilution air 76 which would mix with the combustion products 104 of the combustion flame 80 in order to cool down the temperature of combustion products 104 thereby lowering the temperature of the products 104 proximate the inlet end 32. Referring to FIG. 6, this would decrease the temperature increase one observes near the inlet end 32. Depending upon the burner size and the emitter configuration, the amount of dilution air is selected in order to provide as uniform as possible temperature profile which is shown in solid line 52 in FIG. 6.

Secondly, one can also provide a emitter liner 36 proximate the inlet end 32 which again has the effect of reducing the temperature of emitter 30 proximate the inlet end 32 of emitter 30. The length of emitter liner 36 and the thickness of emitter liner 36 and the materials from which emitter liner 36 are made from are selected depending upon the amount of temperature decrease that is required near the inlet end 32 of emitter 30. It is obvious to those skilled in the art that the longer the liner, the thicker the emitter liner, the greater will be the effectiveness of emitter liner 36 in preventing the heat transferred to emitter 30. In addition, preferably as already discussed above, emitter liner 36 has an interior mirrored or very smooth surface for reflecting heat back into the centre of emitter 30 and by controlling the surface roughness of the emitter liner and also the inner surface of the emitter itself, one can control the contact resistance between the emitter liner 36 and emitter 30, thereby additionally controlling the amount of heat transfer between the emitter liner 36 and emitter 30. In practice stainless steel ASTM 304 grade has been found to be a suitable material for emitter liner 36.

Thirdly, in addition, one can select portions of emitter 30 namely emitter lengths 31 of varying emissivity ranging from a very low emissivity of approximately 0.2 to a very high emissivity ranging to approximately 0.9. This can be accomplished by selecting various materials known in the art for their various emissivities which are well known and measured. The emissivities of emitter lengths 31 can also be varied by altering the surface finish on the materials by for example aluminizing the materials and heat treating the materials and/or selecting differently coated and/or heat treated metal or other material. Depending on the number of emitter lengths 31, which make up the entire length of emitter 30, one can gradually increase the emissivity of emitter lengths 31 as one moves from the inlet end 32 to the exhaust end 34. The emissivity value selected will depend to a large extent on the result one wishes to achieve as well as cost considerations and availability of materials. However the purpose of varying the emissivities of the emitters is to reduce the temperature variations along the length of emitter 30.

Fourthly, one can increase the temperature transferred to the emitter near the exhaust end 34 by introducing exhaust baffle 38, proximate the exhaust end 34. This technique, well known in the art, however has never been used in association with the other technologies discussed in this patent application.

It will be apparent to persons skilled in the art that by using the combination of the dilution air 76 and the emitter liner 36, the variable emissivity emitters and the exhaust baffle 38, one has a great amount of control over the temperature transfer to emitter 30 and thereby one is able to provide as uniform as possible a temperature profile along the length of emitter 30.

The selection of one type of technology over the other will depend upon the total length of emitter tube 30, the materials that are available at the time, the cost involved, the sizes of the emitter tubes as well as the burners and the configuration or the geometry of the area that is to be heated.

It will be apparent to persons skilled in the art, various modifications and adaptations of the structure described above are possible without departure from the spirit of the invention, the scope of which is defined in the appended claims.

I claim:

1. A radiant heater system of the type having an radiant energy emitter conduit, the radiant heater system comprising:

a) an emitter extending at least partly through the area to be heated;

b) a burner means for burning fuel thereby forming combustion products, said burner connected to an inlet end of the emitter to inject thermal energy into the emitter;

c) an exhaust end of the emitter serving to exhaust combustion products; and, d) a means for supplying dilution air to combustion products released by said burner means, wherein the dilution means cools the combustion products proximate said inlet end thereby reducing the emitter temperature proximate said inlet end; and e) wherein said dilution mean includes an air intake sleeve for controlling the amount of combustion air available to said burner, and a blower sized to provide dilution air communicating with said burner.

2. The radiant heater system claimed in claim 1 further comprising a means for lining at least a portion of the interior of said emitter, such that the liner means reduces the heat transferred to the emitter adjacent said liner.

3. The radiant heater system claimed in claim 1 further comprising an emissivity means for varying the emissivity of said emitter along at least a portion of the length of the emitter such that the emissivity means is employed to control the amount of radiant heat emitted by the emitter as a function of the distance along the emitter.

4. The radiant heater system claimed in claim 1, wherein said air intake sleeve also providing for a dilution air passageway directing dilution air for mixing with said combustion products, proximate said inlet end.

5. The radiant system claimed in claim 4, wherein said air intake sleeve includes air inlets of pre selected size for controlling the amount of combustion air available to said burner.

6. The radiant system claimed in claim 5, wherein said air intake sleeve being cup shaped and mounted concentrically around a burner cup of said burner means, thereby directing dilution air around the outer circumference of said burner.

7. The radiant system claimed in claim 4, wherein said dilution air passageway sized to provide dilution air in the amount of 1.0 times the amount of the stoichiometrically required combustion air to 10 times the amount of the stoichiometrically required combustion air.

8. The radiant system claimed in claim 4, wherein said dilution air passageway is preferably sized to provide dilution air in the amount of 2 times the amount of the stoichiometrically required combustion air to 4.5 times the amount of the stoichiometrically required combustion air.

9. The radiant heater system claimed in claim 2 wherein said lining means includes a liner adapted to lie adjacent a portion of the inner periphery of said emitter.

10. The radiant heater system claimed in claim 2 wherein said lining means includes a sheet metal liner formed to lie adjacent a portion of the inner periphery of said emitter.

11. The radiant heater system claimed in claim 10, wherein said emitter being tubular and said sheet metal liner including an emitter liner gap along the bottom of the emitter inner periphery for minimizing heat distortion of the emitter and promoting a more uniform vertical temperature distribution within said emitter.

12. The radiant heater system claimed in claim 11, wherein said sheet metal liner is selected from the group including, cold rolled steel, hot rolled steel, aluminized cold rolled steel, aluminized hot rolled steel, oxidized steel and stainless steel.

13. A radiant heater system of the type having an radiant energy emitter conduit, the radiant heater system comprising:

a) an emitter extending at least partly through the area to be heated;

b) a burner means for burning fuel thereby forming combustion products, said burner connected to an inlet end of the emitter to inject thermal energy into the emitter;

c) an exhaust end of the emitter serving to exhaust as combustion products;

d) a means for supplying air to combustion products released by said burner means, wherein the dilution means cools the combustion products proximate said inlet end thereby reducing the emitter temperature proximate said inlet end;

e) further comprising a means for lining at least a portion of the interior of said emitter, such that the liner means reduces the heat transferred to the emitter adjacent said liner;

f) wherein said lining means includes a sheet metal liner formed to lie adjacent a portion of the inner periphery of said emitter; and g) wherein said sheet metal liner including a smooth outer surface and said emitter having a rougher inner surface to maximize contact resistance between said sheet metal liner and said emitter.

14. The radiant heater system claimed in claim 1 wherein said emissivity means includes said emitter being constructed of numerous emitter lengths wherein each emitter length having a preselected emissivity, wherein emitter length emissivities are preselected in order to maximize the temperature uniformity of the emitter along the emitter length.

15. The radiant heater system claimed in claim 14, wherein said emmisivities of said emitter lengths are selected to vary from 0.1 nearest the inlet and to 0.9 nearest the outlet end.

16. The radiant heater system claimed in claim 14, wherein said emitter lengths are selected from the group including mild steel, aluminized mild steel, zinc coated mild steel, aluminum and zinc coated mild steel, oxidized mild steel, hot rolled steel, heat treated mild steel, oxidized mild steel, aluminized and heat treated mild steel, and stainless steel.

17. The radiant heater system claimed in claim 1 further comprising a baffle inserted into the interior of said emitter proximate the exhaust end for promoting increases heat transfer to said emitter proximate said exhaust end and thereby providing a more uniform emitter temperature profile along the length of the emitter.

18. The radiant heater system claimed in claim 1, further including:

(a) a means for lining at least a portion of the interior of said emitter, such that the liner means reduces the heat transferred to the emitter adjacent said liner; and, (b) an emissivity means for varying the emissivity of said emitter along at least a portion of the length of the emitter such that the emissivity means is employed to control the amount of radiant heat emitted by the emitter as a function of the distance along the emitter.

19. The radiant heater system claimed in claim 18, further including:

(a) a baffle inserted into the interior of said emitter proximate the exhaust end for promoting increases heat transfer to said emitter proximate said exhaust end and thereby providing a more uniform emitter temperature profile along the length of the emitter.

* * * * *